US010603778B2

(12) United States Patent
Michel et al.

(10) Patent No.: US 10,603,778 B2
(45) Date of Patent: Mar. 31, 2020

(54) PNEUMATIC DRIVING DEVICE WITH SWIVEL COUPLING

(71) Applicant: Etablissements Georges Renault, Saint Herblain (FR)

(72) Inventors: Loic Michel, Saffre (FR); Nicolas Julou, Bouguenais (FR); Pascal Roussy, Montfort sur Meu (FR)

(73) Assignee: ETABLISSEMENTS GEORGES RENAULT, Saint Herblain (FR)

( * ) Notice: Subject to any disclaimer, the term of this patent is extended or adjusted under 35 U.S.C. 154(b) by 148 days.

(21) Appl. No.: 15/718,798

(22) Filed: Sep. 28, 2017

(65) Prior Publication Data

US 2018/0085910 A1 Mar. 29, 2018

(30) Foreign Application Priority Data

Sep. 29, 2016 (FR) ..... 16 59304

(51) Int. Cl.

| | |
|---|---|
| ***B25F 5/02*** | (2006.01) |
| ***B25B 23/00*** | (2006.01) |
| ***B25B 21/00*** | (2006.01) |
| ***B25B 21/02*** | (2006.01) |

(52) U.S. Cl.

CPC ..... *B25F 5/02* (2013.01); *B25B 21/00* (2013.01); *B25B 21/02* (2013.01); *B25B 23/0007* (2013.01)

(58) Field of Classification Search

CPC . B25F 5/02; B25B 21/00; B25B 21/02; B25B 23/0007; B25B 21/023; B25B 21/004; B25B 21/005; B25B 13/466

See application file for complete search history.

(56) References Cited

U.S. PATENT DOCUMENTS

| | | | | |
|---|---|---|---|---|
| 2,299,643 A * | 10/1942 | Moody | F16L 37/088 251/149.1 |
| 4,298,074 A * | 11/1981 | Mattchen | A61B 17/1624 173/129 |
| 6,702,333 B1 * | 3/2004 | Oetiker | B25F 5/00 285/235 |
| 2003/0121680 A1 * | 7/2003 | Izumisawa | B25B 21/02 173/93.5 |

(Continued)

OTHER PUBLICATIONS

English Translation of French Written Opinion dated Jun. 13, 2017 for corresponding French Application No. 1659304, filed Sep. 29, 2016.

(Continued)

*Primary Examiner* — Robert J Scruggs
(74) *Attorney, Agent, or Firm* — David D. Brush; Westman, Champlin & Koehler, P.A.

(57) ABSTRACT

A pneumatic screw driving device includes a body having a grip to be held by an operator and housing a pneumatic motor, a rotating terminal member for cooperating with a screw driving element and liable to be driven in rotation by the motor, and a coupling piece for an air feed tube for supplying air to the motor. The coupling piece includes a first element partly mounted inside the grip, and a second element external to the grip for being connected to the air feed tube. The second element is fixedly attached to the first element by a rotating link. The first element and the second element are mobile relative to each other.

10 Claims, 5 Drawing Sheets

(56) References Cited

U.S. PATENT DOCUMENTS

2006/0278416 A1* 12/2006 Tanji ..... B25F 5/00
173/90

OTHER PUBLICATIONS

French Search Report dated Jun. 13, 2017 for corresponding French Application No. 1659304, filed Sep. 29, 2016.
"Swing Coupling by Oetiker", SC Training Presentation Binder/, Oct. 2003.

* cited by examiner

PNEUMATIC DRIVING DEVICE WITH SWIVEL COUPLING

1. CROSS-REFERENCE TO RELATES APPLICATION

This Application claims priority from and the benefit of French Patent Application FR 1659304, filed Sep. 29, 2016, the content of which is incorporated herein by reference in its entirety.

2. FIELD OF THE INVENTION

The field of the invention is that of tooling and toolkits.

More specifically, the invention relates to the design and manufacture of portable tools for the screwing in and unscrewing of fastening elements.

The invention can be applied especially to pneumatic screwing/unscrewing tools such as impact wrenches.

3. PRIOR ART

In the field of automobile repairs, for example, pneumatic impact wrenches are especially used to screw in or unscrew the fastening elements that are situated beneath the engine hood or on accessible parts on the exterior of the vehicle (such as the wheels).

As illustrated in FIGS. 1A and 1B, an impact wrench classically comprises a casing 30 having a handle or grip 31. The casing 31 houses a percussion mechanism or striker and motor means 32, the output of which is connected to a terminal rotary unit 37 designed to cooperate with an element (not shown) to be screwed in or unscrewed. The motor 32 is powered by an air feeder conduit 33 designed to rotationally drive the motor 32, in which a feed valve 34 is housed.

The passage of a trigger 35 from its released position to its recessed or pushed-in position places the feed valve 34 in its open position and enables the motor 32 to be supplied with compressed air.

On the lower part of the grip 31, a coupling piece 36 is mounted for a pressurized-air feed tube (not shown). This coupling piece 36 has a steel connector 361 at its end. The steel connector 361 is shaped like a nut meant to be reversibly coupled to a steel nozzle of an air inlet tube (not shown). The coupling piece 36 is mounted so as to be pivoting in the air feed conduit 33 of the grip 31, to provide the air inlet tube with a certain rotational capacity.

Numerous mechanisms exist, some of them with nuts and/or joining screws, situated at places that are hard to reach for tightening with a pneumatic driving device.

Thus, the operator has to orient the tool in a wide range of directions depending on the position and orientation of the components to be assembled.

However, the rigidity of the air inlet tube and its nozzle do not provide the operator with optimum handling freedom. Thus, in restricted environments, the operator encounters problems of orientation of the tube and the tool, and this calls for constant effort during certain operations to counter the torque generated by this lever arm on the operator's wrist. This type of position is not ergonomic for the operator and causes him or her to experience discomfort and fatigue, until the possible appearance of muscular-skeletal disorders.

In certain cases, this rigidity prevents the tool from penetrating any screw driving area encumbered or congested with various elements, so much so that the operator cannot carry out the operation to screw or unscrew a fastener.

To suitably orient the terminal rotary element of the tool, and given limited accessibility to the element to be screwed in, the operator sometimes has to fold the flexible air inlet tube in order to obtain the desired orientation. This can cut off or, at the very least, reduce the intake of air, which is not desirable.

This type of non-flexible straight coupling, illustrated in FIGS. 1A and 1B, between the pneumatic driving device and the air inlet tube is not entirely satisfactory.

A swivel coupling 40 illustrated in FIG. 1C can be interposed between the connector 361 of the pneumatic driving device and the feed tube in order to enable an orientation of the tube along three axes. Such a coupling 40, added on to the intake connector 361 of the tool, is however bulky. Thus, the distance "d" between the plane of the lower surface of the grip and the axis of the tube in the position of the coupling 40 illustrated in FIG. 1C is a minimum of 40 mm.

Such a coupling 40 moreover remains relatively fragile, takes up space and can cause pressure loss. It is moreover an additional intermediate element.

Such pneumatic driving devices are thus still open to further improvement, especially as regards handling ease and compactness.

4. SUMMARY OF THE INVENTION

An aspect of the present disclosure relates to a pneumatic driving device comprising a body comprising a grip that is to be held by an operator and that houses:

pneumatic motor means, a rotating terminal member meant to cooperate with a screwing/unscrewing element and liable to be driven in rotation by said motor means, a coupling piece for an air feed tube for supplying air to the motor means. said coupling piece comprising a first element partly mounted inside said grip, and a second element external to the grip and intended for being connected to said air feed tube.

According to the invention, said second element is fixedly attached to said first element by a first rotating link, said first element and said second element being mobile relative to each other.

Thus, the invention relies on a wholly original approach which consists in proposing a swivel coupling made of two parts and partly integrating this connector into the pneumatic driving device.

In other words, the connector is formed by two mobile parts that are mobile relative to each other, one of the parts being partly situated in the grip.

This eliminates the intermediate coupling of the prior art, mounted outside the grip of the pneumatic driving device, and thus improves the compactness of the pneumatic driving device.

It thus becomes far less tedious to work in restricted spaces.

Besides, the coupling piece allows the operator to adjust the position of the air feed tube to find the most comfortable working position in order to carry out the operation to screw or unscrew a fastener for which he is responsible.

The coupling piece therefore improves the handling ease of the tools.

Besides, it reduces pressure loss (by providing a constant section) and improves:

the capacity of the pneumatic driving device to access encumbered or congested areas, the robustness of the junction between the air feed tube and the pneumatic driving device, its safety of use, and its ergonomic qualities.

According to one particular aspect of the invention, said first element has a first cylindrical bore and said second element has a second cylindrical bore that leads into the first cylindrical bore and is extended by a third cylindrical bore designed to communicate with said air feed tube.

According to one particular aspect of the invention, the axis of said second bore is inclined relative to the respective axes of said first and second bores.

According to one particular aspect of the invention, in a first position, the axis of the first bore of the first element is parallel to the axis of the third bore of the second element and does not coincide with this axis.

According to one particular aspect of the invention, in a second position, the axis of the third bore of the second part extends substantially in parallel and such that it is offset relative to the axis of the rotating terminal member or of said motor means.

In this position, the tube extends substantially in parallel to the operator's arm.

According to one particular aspect of the invention, said second part extends in parallel to the axis with a tolerance of +/−10°.

According to one particular aspect of the invention, in said second position, the angle between the axes of the first and third bores is greater than 60° and smaller than 90°.

According to one particular aspect of the invention, said angle is equal to 75°.

According to one particular aspect of the invention, the axis of the third bore is distinct from the axis of the first bore whatever the position of the second element relative to the first element.

The axes are distinct so as to make a passage with a greater diameter than if the axes were to coincide, thus enabling a passage of air into the intake channel of the coupling piece without any pressure loss.

According to one particular aspect of the invention, in said second position, the distance between the plane defined by the lower surface of the grip and the axis of the third bore is smaller than or equal to 10 mm.

According to one particular aspect of the invention, the coupling piece is fixedly attached to the grip by a second rotating link.

According to one particular aspect of the invention, the first element extends into the interior of the said grip on a length equal to at least half of the length of the grip.

5. LIST OF FIGURES

Other feathers and advantages of the invention shall appear more clearly from the following description of a preferred embodiment, given by way of a simple, illustratory and non-exhaustive example and from the appended drawings, of which:

6. DESCRIPTION OF ONE EMBODIMENT OF THE INVENTION

Figure 1A:
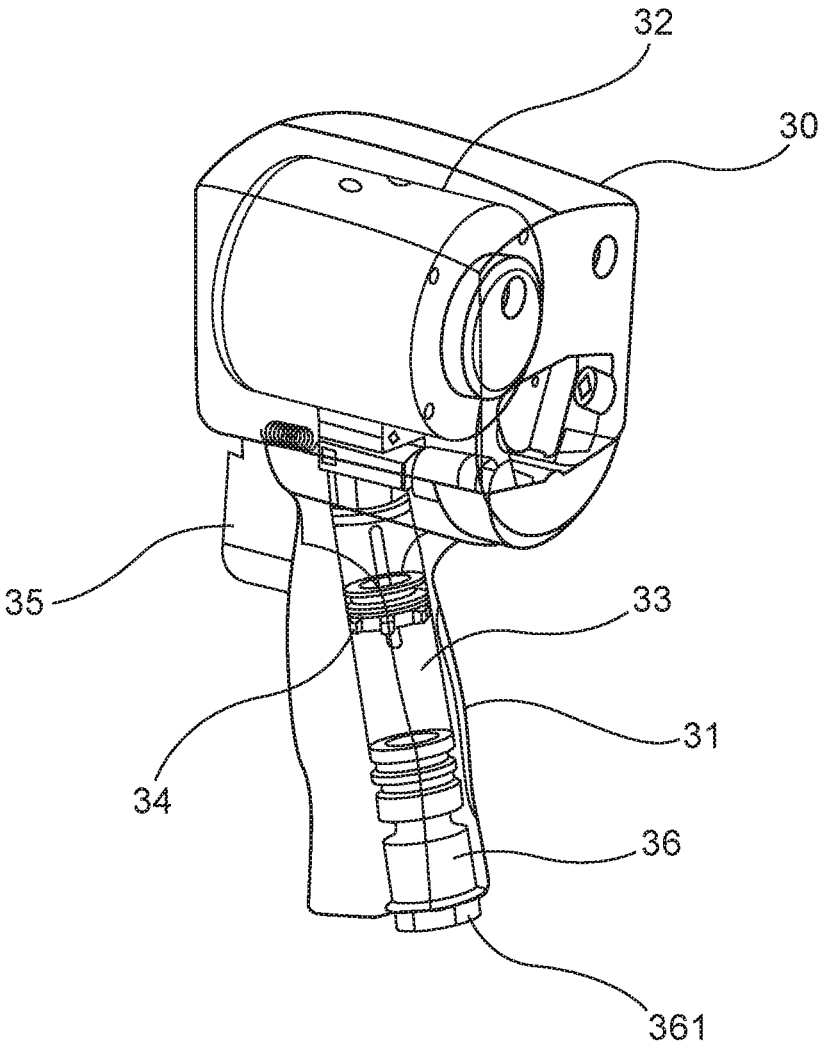
Fig. 1A (PRIOR ART)
FIG. 1A is a partial schematic view of a pneumatic driving tool according to the prior art.
Figure 1B:
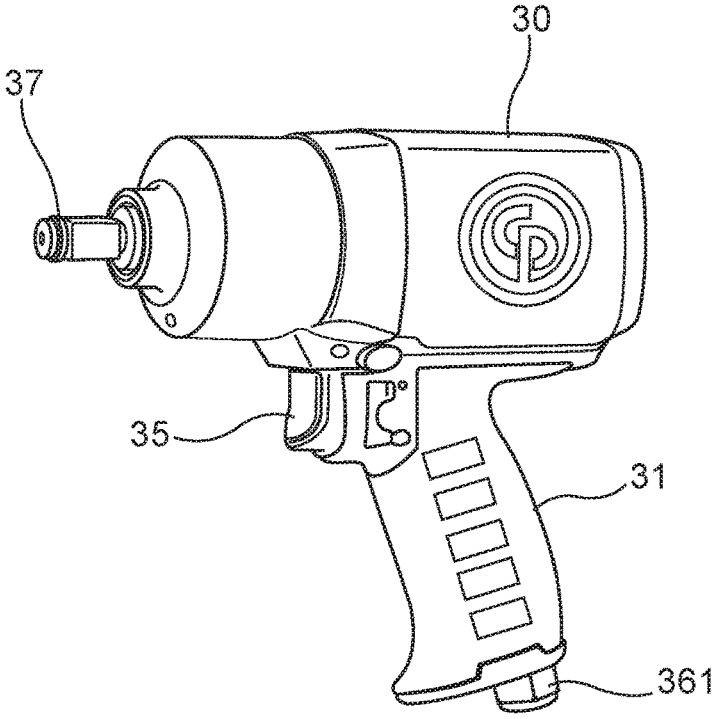
Fig. 1B (PRIOR ART)
FIG. 1B is three-quarter or perspective view of a pneumatic driving tool according to the prior art.

Referring to FIGS. 2A to 5B, we present an embodiment of a pneumatic driving tool or device according to the invention, such as a pneumatic impact wrench.

Here below in this document, the axes X, Y and Z constitute an orthonormal referential system.

Such a portable pneumatic driving device 10 comprises a casing or body 21 which extends along an axis A parallel to the axis X. This driving tool comprises a rotary terminal member 23 meant to cooperate with a fastening element (not shown) or element to be screwed in, in order to screw this element in.

The casing 21 houses a pneumatic motor 22 which is known per se and shall not be described here in detail.

The casing 21 has a grip 24 made of plastic and an actuating trigger 29. This trigger 29 is positioned on the grip 24 in such a way that a user can actuate the trigger 29 with the index finger, the hand surrounding the grip 24 of the tool. The grip extends so as to be inclined relative to the orthonormal referential axis Y.

The grip 24 houses an air feed conduit 26 that is to lead a flow of pressurized air towards the motor 22 of the tool and an outlet passage (not shown) to lead exhaust air from the motor 22 out of the casing 21.

The air feed conduit 26 houses compressed-air feeder means comprising a feed valve 27. The valve 27 is moveable between:

a closed position in which it prevents the passage of compressed air from the air feed conduit 26 to the motor 22, and an open position in which it is inclined so as to enable the passage of compressed air towards the motor 22.

A return spring 28 is housed inside the air feed conduit 26 and tends to keep the valve 27 in its closed position.

The passage of the trigger 29 from its released position to its recessed or pressed-in position places the valve 27 in its open position and feeds the motor 22 with compressed air. The passage of the trigger 29 from its recessed position to its released position returns the valve 27 to its closed position and shuts off the supply to the motor 22.

The pneumatic driving device 10 furthermore comprises means of manual reversal of the sense of rotation of the rotary terminal member 23, which are known per se to those skilled in the art and shall not be described in detail, and can enable an operator to reverse the sense of rotation of the motor shaft to carry out an unscrewing operation.

Besides, the grip 24 is provided with a coupling piece or connector 25 to a compressed air supply network. The coupling piece 25 is attached to the grip 24 by a second rotating link. More specifically, the coupling piece 25 is mounted in the air feed conduit 26 upstream to the valve 27 so that the coupling piece 25 and the grip 24 are rotationally mobile relative to each other.

This second rotating link is configured so that the coupling piece 25 can pivot by 360° and take several angular positions about the axis B.

Figure 2A:
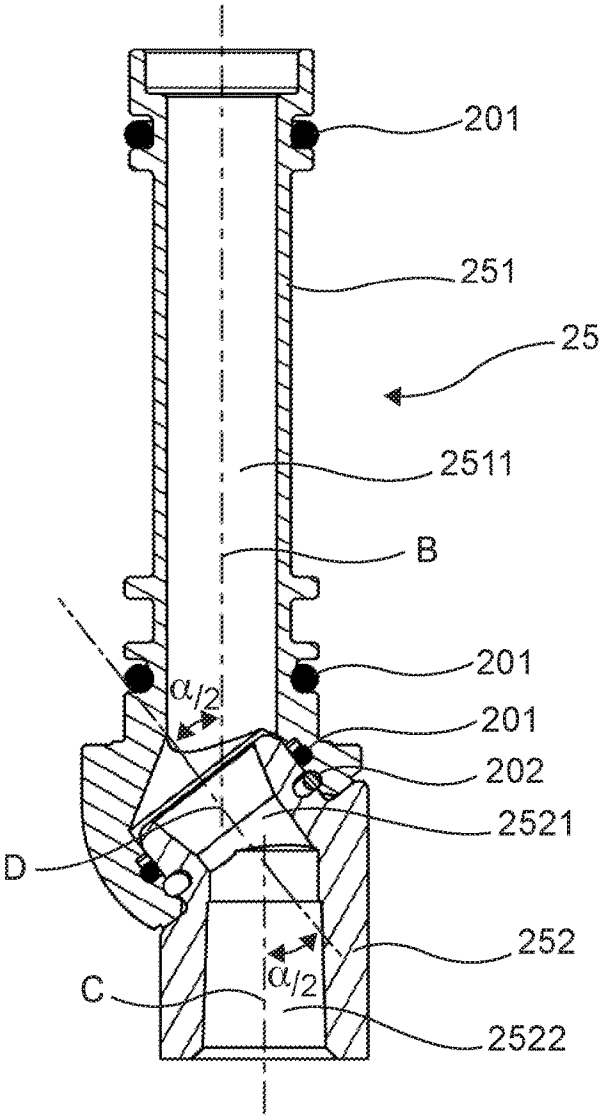
FIG. 2A is a view in longitudinal section of a coupling implemented in a pneumatic driving device compliant with the invention.
Figure 2B:
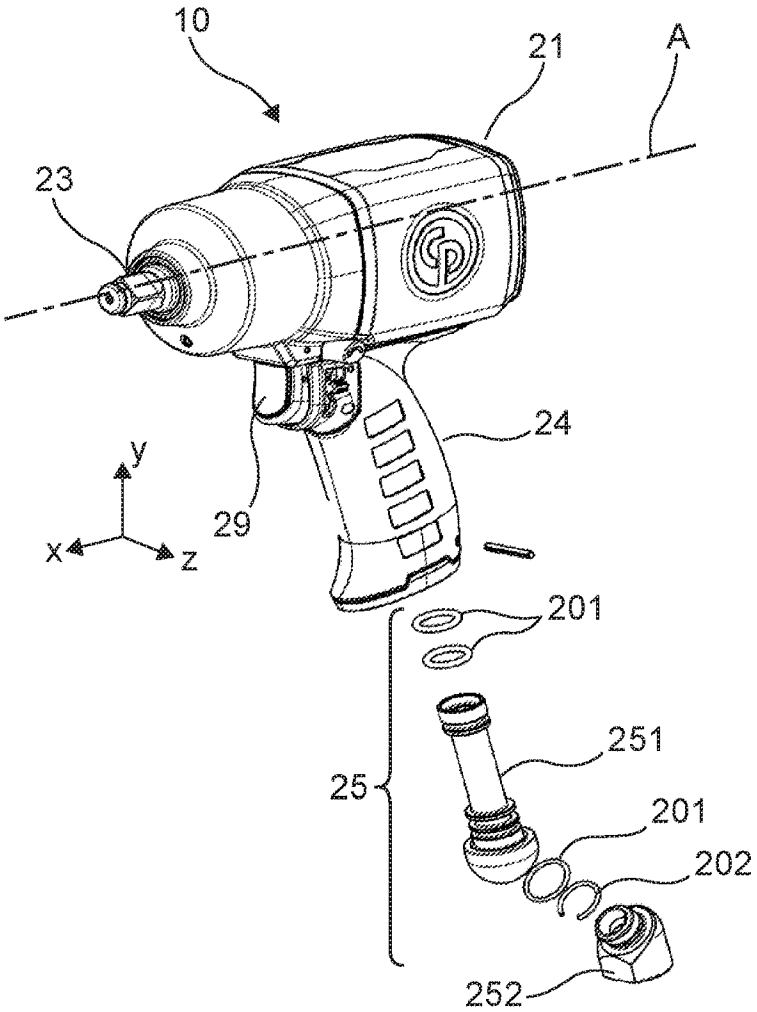
FIG. 2B is an exploded view of the connector of FIG. 2A and of a pneumatic driving tool in which it is mounted.

The coupling piece 25 is illustrated by itself in the section view of FIG. 2A and in an exploded view in FIG. 2B. Besides, it is illustrated in the detailed view, in section, when it is mounted in the air feed conduit 26 of the grip 24.

It is formed by two sub-elements or parts mounted so as to be pivoting relative to each other via a first rotating link.

The first element 251, which has a general tube shape, has a single cylindrical bore called a first bore 2511 extending along a longitudinal axis B.

The second element 252, which has an elbow shape, has a second cylindrical bore 2521 extending along a longitudinal axis D and a third cylindrical bore 2522 forming an elbow and extending along a longitudinal axis C, called an intake axis, the second cylindrical bore 2521 leading into an extremity in the first cylindrical bore 2511 and into the other extremity in the third cylindrical bore 2522.

Thus, the first element 251 and the second element 252 of the coupling piece 25 are connected to each other by a sealed rotational tight-fitting element along a third axis D distinct from the first and second axes B, C respectively.

It can be noted that the upper tube-shaped part of the first element 251 is fitted into the air feed conduit 26 of the grip 24. In the example illustrated, this tube-shaped part extends in the air feed conduit 26 over more than half of the height of the grip 24. This spherical lower part of the first element 251 comes into contact against the plane P formed by the lower surface of the grip 24.

Advantageously, this tight-fitting element extends along the plastic grip of the first element 251 and therefore of the coupling piece 25, distributes the stresses optimally and reduces the space requirement of the coupling piece 25 along the axis of the grip 24 (which corresponds to the axis B of the coupling piece 25).

In other words, compared with the prior art, the contact surface between the internal part of the grip of the coupling piece 25 and the plastic shell of the grip is increased, thus reducing concentrations of force between the first element 251 and the plastic grip 24.

Figure 3A:
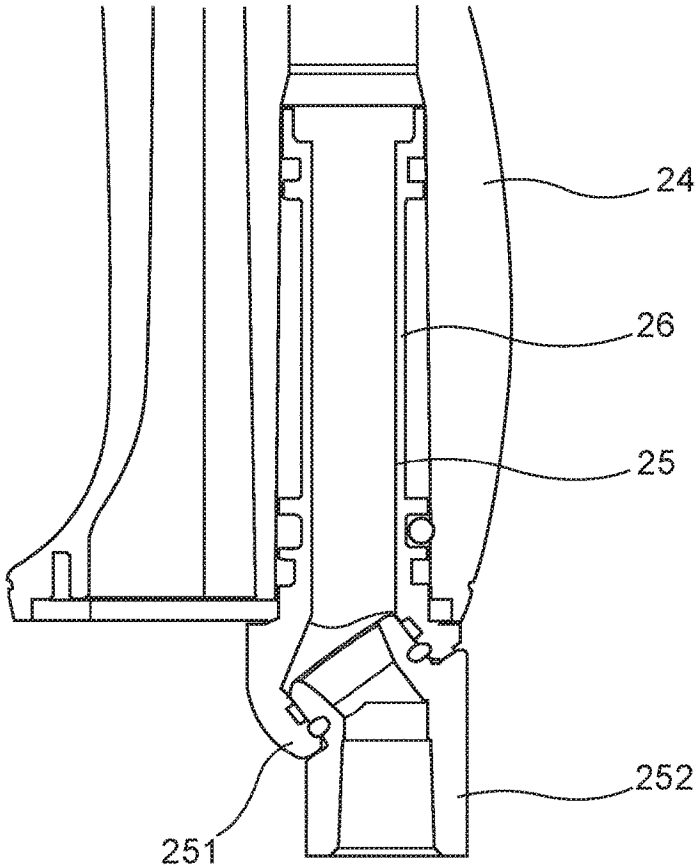
FIG. 3A is a detailed view, in section; of the coupling when it is mounted in a pneumatic driving tool.
Figure 3B:
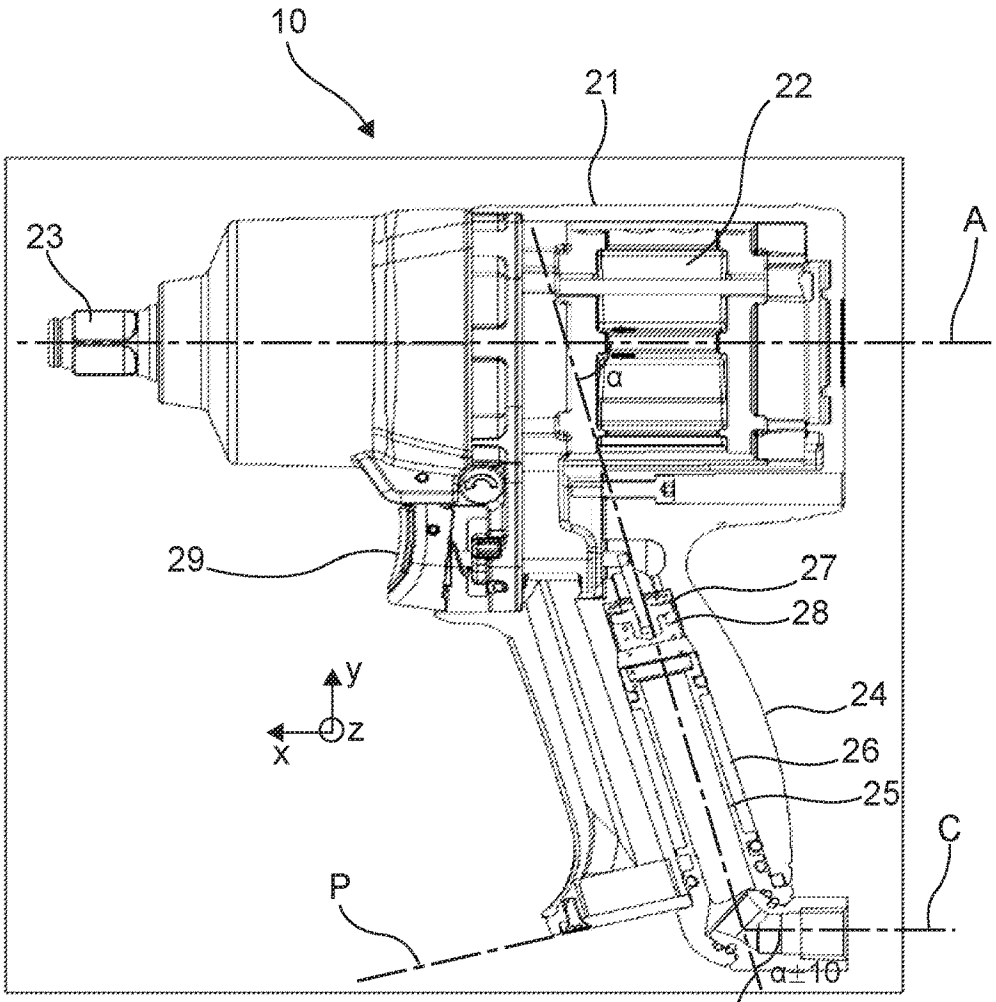
FIG. 3B is a view in section of a pneumatic driving tool according to the invention.
Figure 4A:
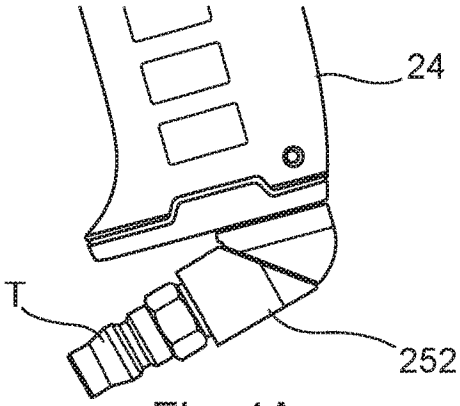
FIGS. 4A to 4C are detailed views of the grip of a pneumatic driving tool according to the invention, showing the different positions of the coupling.
Figure 4B:
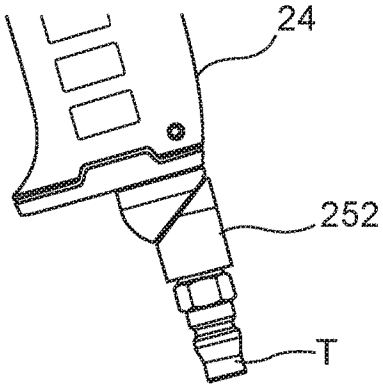

In the position of the coupling piece 25 illustrated in FIGS. 2A, 3A and 4B, the axis C is parallel with the axis B, the axis B being inclined relative to the axes B and C by an angle equal to $\alpha/2$ as illustrated in FIG. 3B.

The mounting of the coupling piece 25 in the grip 24 uses several O-ring seals 201 and an elastic retaining ring 202 for holding the second rotary element 252 (which can be seen in FIGS. 2A and 2B).

The cylindrical bores 2511, 2521, 2522 form a compressed-air flow channel or intake channel, the pressurized air coming from an air inlet tube T (partially illustrated in FIGS. 4A to 4C) passing from the second element 252 towards the first element 251, which is connected to the air feed conduit 26 in which the air feed valve 27 for the motor 22 is positioned.

Figure 4C:
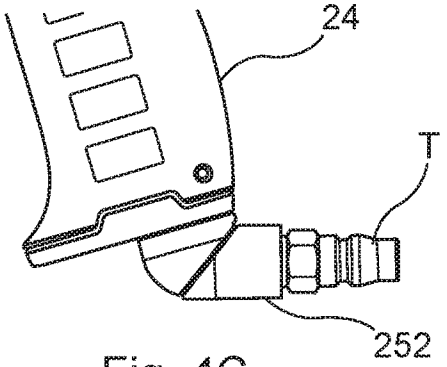
Figure 5A:
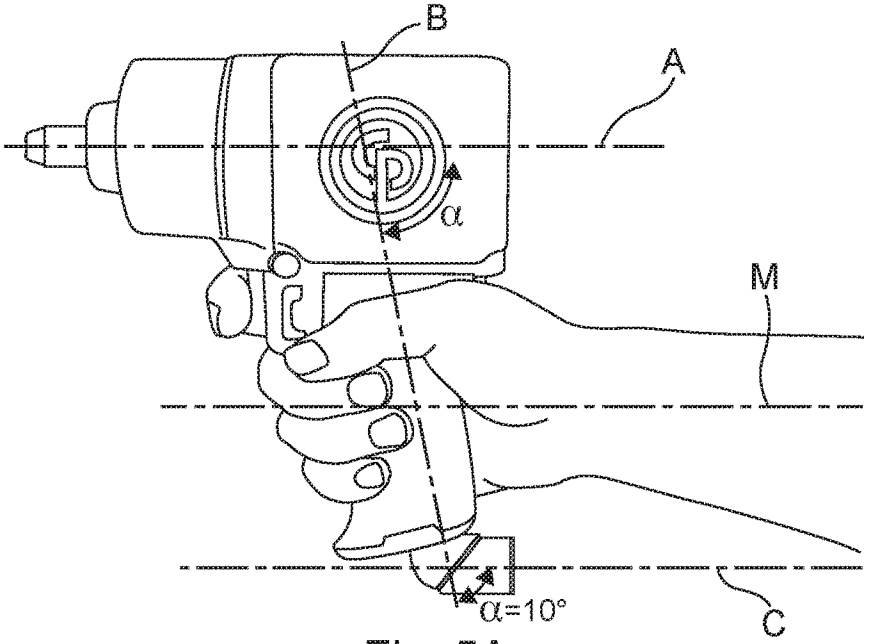
FIGS. 5A and 5B are views of a pneumatic driving tool compliant with the invention, FIG. 5A showing the tool when it is held in a user's arm.

A first position of the coupling piece 25 is illustrated in FIG. 4C. In this position, the angle $\alpha$ between the first element 251 and the second element 252 is 75° (FIGS. 5A and 5B), these two elements 251, 252 forming an elbow. The element 252 is thus parallel to the axis A of the motor and therefore substantially parallel to the general direction M of the operator's arm (FIG. 5A).

Thus, in the case of a need to access an encumbered or congested zone, the tube is:

- neither an obstacle to the progress of the tool in this area which would be the case if the tube were to be connected to the tool with a straight coming (coaxial to the axis B),
- nor a source of discomfort to the operator if, as in the case of the use of a 90° coupling, this tube takes up position against the operator's arm.

A second position of the connecting piece 25 is illustrated in FIG. 4B. In this position, the intake axis C of the second element 252 and the axis B of the first element 251 are parallel. The coupling is thus substantially straight. This position substantially corresponds to the one given by a straight coupling (coaxial to the axis B). This type of tube orientation is suited to working situations of the type where the wheel is being tightened/loosened when the grip is used vertically and when the tube takes a natural vertical orientation.

It can be noted that, in the position of FIG. 4B, the axes B and C are distinct so as to create a passage 2521 with a greater diameter than if the axes B and C were to coincide, thus enabling a passage of air in the intake channel of the coupling piece 25 without any pressure loss.

Figure 5B:
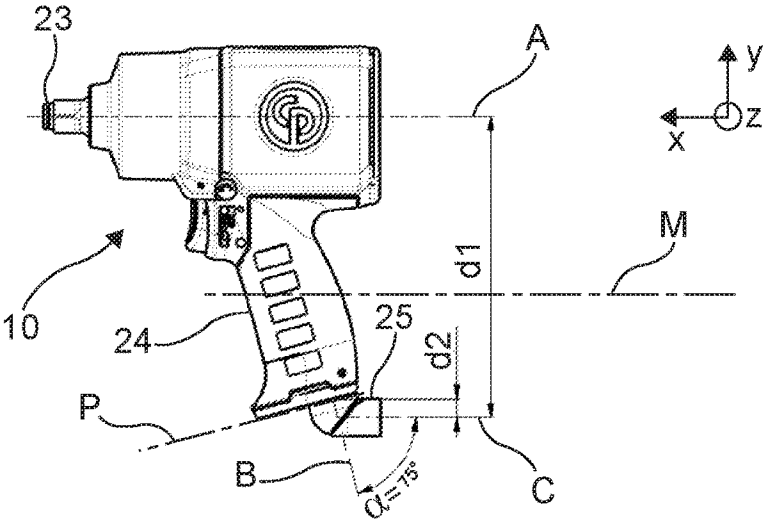

Besides, the angle between the axis B and the axis C varies between 0° (parallel axes), in the position of FIG. 4B, and 75° (axis C parallel to the axis A of the tool) in the positions of FIGS. 4C, 5A and 5B.

The angle between the axes A and B denoted as a (alpha), equal to 75° for example, and the angle between the axes B and C is also equal to a (alpha) with a tolerance of +/−10° (FIG. 3B).

The shape of the coupling piece according to the invention reduces the distance between the plane P of the lower surface of the grip, called an intake plane, and the axis of the tube T (which corresponds to the axis C). This distance $d_2$ is of the order of 9.4 mm in the position of FIG. 5B.

During use, because the axis C of the air inlet tube is parallel to the axis A of the tool (the distance $d_1$ between these two axes is 153 mm in FIG. 5B) and no longer parallel to the intake plane P, the tube T extends along the operator's arm, his hand being used to hold the grip 24 of the tool. Since the operator's arm is oriented along the axis A of the tool, it is not in contact with the tube T.

In addition, because the axis C of the air inlet tube T connected to the tool 10 is proximate to the intake plane P, the tool of the invention has improved accessibility to the parts to be screwed in and improved range of action as well for this tool. This therefore increases the operator's productivity.

The ergonomy of the tool and its capacity to access the encumbered zones are thus increased.

Figure 1C:
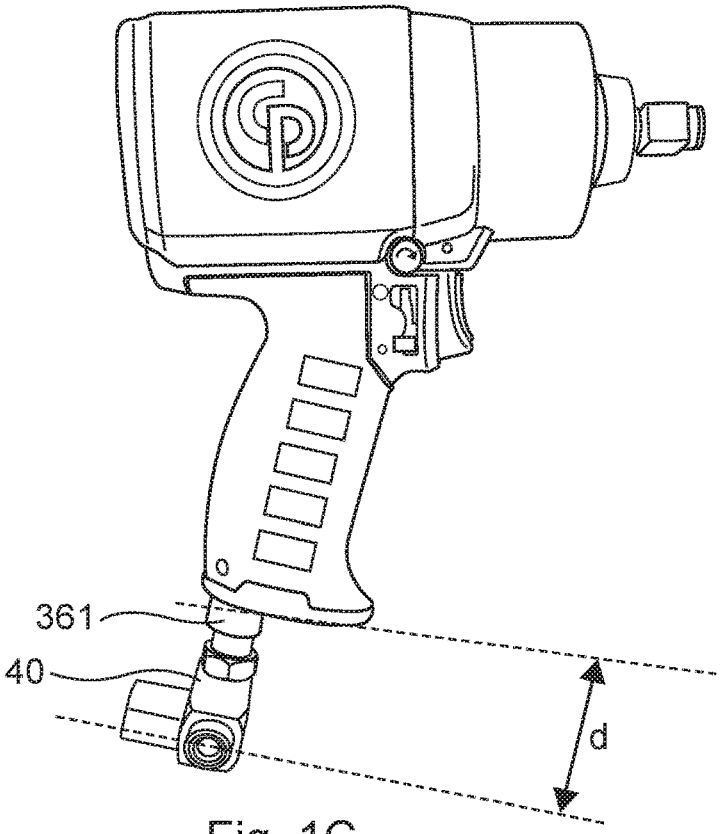
FIG. 1C is a view of the pneumatic driving tool of FIG. 1B showing the mounting of a swivel coupling on the connector of the grip of the tool.

The integration of the coupling piece 25 into the grip 24 furthermore validates the entire tool in terms of safety (drop test). This is not always the case with an added-on element as described with reference to FIG. 1C.

In the case of the use of an added-on elbowed coupling (the case of FIG. 1C), these forces of this added-on element were not taken into account in the design and development of the structure of the tool. As a consequence, if the tool is dropped, cracks can appear in the grip made of composite material or this grip may even get totally broken, causing the tube to be released under pressure. Such an event leads the tube to make violent motions under the effect of air expansion, such as whiplash motions, which could injure the operators.

The designing of the coupling piece 25 therefore takes account of this safety aspect by:

increasing the surface area of contact between the internal part of the grip of the connector piece 25 and the plastic shell of the grip, thus reducing concentrations of force between the first element 251 and the plastic grip 24.

adding if need be an internal reinforcement beam in the grip of the tool.

The pneumatic driving device according to the invention can be used in the industrial field or in automobile repairs, for example for operations of maintenance on the wheels, the engine, the transmission, the front axle or the rear axle in particular.

An exemplary embodiment of the present disclosure overcomes the prior-art drawbacks.

An exemplary embodiment improves handling ease, safety of use, capacity of access to encumbered zones and the ergonomy of the pneumatic driving devices.

An exemplary embodiment provides a pneumatic driving device which, in at least one embodiment, is a simply designed, reliable and low-cost device.

Although the present disclosure has been described with reference to one or more examples, workers skilled in the art will recognize that changes may be made in form and detail without departing from the scope of the disclosure and/or the appended claims.

The invention claimed is:

1. A pneumatic driving device comprising:

a body comprising a grip to be held by an operator and housing:

a pneumatic motor, a rotatable terminal member configured to cooperate with a screwing/unscrewing element to be driven in rotation by said motor, and a coupling piece for an air feed tube for supplying air to the motor, said coupling piece comprising a first element partly mounted inside said grip, and a second element external to the grip and for being connected to said air feed tube, wherein said second element is fixedly attached to said first element by a first rotatable link, said first element and said second element being mobile relative to each other, and wherein said first element has a first cylindrical bore and said second element has a second cylindrical bore that leads into the first cylindrical bore and is extended by a third cylindrical bore that is to communicate with said air feed tube, an axis of said second bore being inclined relative to respective axes of said first and third bores.

2. The device according to claim 1, wherein, in a first position, the axis of the first bore of the first element is parallel to the axis of the third bore of the second element and does not coincide with the axis of the third bore.

3. The device according to claim 1, wherein, in a second position, the axis of the third bore of the second part extends substantially in parallel and such that it is offset relative to the axis of the rotatable terminal member or of said motor.

4. The device according to claim 3, wherein said second part extends in parallel to the axis of the motor with a tolerance of +/−10°.

5. The device according to claim 3, wherein, in said second position, the angle between the axes of the first and third bores is greater than 60° and smaller than 90°.

6. The device according to claim 5, wherein said angle is equal to 75°.

7. The device according to claim 3, wherein, in said second position, the distance between the plane defined by a lower surface of the grip and the axis of the third bore is smaller than or equal to 10 mm.

8. The device according to claim 1, wherein the axis of the third bore is distinct from the axis of the first bore whatever the position of the second element relative to the first element.

9. The device according to claim 1, wherein the coupling piece is fixedly attached to the grip by a second rotatable link.

10. The device according to claim 1, wherein the first element extends into an interior of the said grip on a length equal to at least half of the length of the grip.

* * * * *